US006080186A

United States Patent [19]

Pedersen et al.

[11] Patent Number: 6,080,186

[45] Date of Patent: Jun. 27, 2000

[54] TEAT, IN PARTICULAR OF THE COMFORTER TYPE

[76] Inventors: Terje S. Pedersen, Giskegt. 2A, N-4300 Sandnes; Bjørn Øgaard, Orreveien 5L, N-0393 Oslo, both of Norway

[21] Appl. No.: 09/214,413

[22] PCT Filed: Jun. 20, 1997

[86] PCT No.: PCT/NO97/00160

§ 371 Date: Dec. 28, 1998

§ 102(e) Date: Dec. 28, 1998

[87] PCT Pub. No.: WO98/02132

PCT Pub. Date: Jan. 22, 1998

[51] Int. Cl.[7] ..... A61J 17/00

[52] U.S. Cl. ..... 606/234

[58] Field of Search ..... 606/234, 235, 606/236; 215/11.1, 11.2, 11.3, 11.4, 11.5, 11.6

[56] References Cited

U.S. PATENT DOCUMENTS

| | | | |
|---|---|---|---|
| 4,078,570 | 3/1978 | Frodrich et al. | 606/236 |
| 5,133,740 | 7/1992 | Kussick | 606/234 |

FOREIGN PATENT DOCUMENTS

| | | | |
|---|---|---|---|
| 0400217 | 12/1990 | European Pat. Off. | A61C 7/08 |
| 3840178 | 5/1990 | Germany | A61J 11/00 |
| 2278549 | 12/1994 | United Kingdom | A61J 17/00 |

*Primary Examiner*—Michael Buiz
*Assistant Examiner*—Vy Q. Bui
*Attorney, Agent, or Firm*—Knobbe, Martens, Olson & Bear, LLP

[57] ABSTRACT

A pacifier of the dummy type comprises a bubble body (18) on which the child sucks, and a stop disc (16) against which the child's lips (22, 24) rest supportingly in the pacifier's position of use. The bubble body (18) and the stop disc (16) are interconnected through an intermediate transition and connecting portion (20) accommodating possible front teeth (26, 28)/gums. The bubble body (18) is given an asymmetrical shape in respect of its connection point on the transition and connecting portion (20), comprising at least one elongate leg **(18*a*) sloping downwardly in its longitudinal direction towards the free end thereof, forming an impact and support face for the adjacent portion of the tongue (34). The stop disc (16) comprises an upper and a lower portion (16*a*, 16*b*) somewhat displaced from each other in the longitudinal axial direction of the pacifier, forming suitable stop and support faces for the child's lips (22, 24)**.

11 Claims, 3 Drawing Sheets

TEAT, IN PARTICULAR OF THE COMFORTER TYPE

FIELD OF THE INVENTION

The present invention relates to a pacifier, in particular of the comforter type, intended to satisfy small children's uncovered need to suck.

BACKGROUND OF THE INVENTION

The use of pacifiers and dummies has increased very much during the last years at the expense of finger sucking. Approximately 90% of small children develop a sucking habit and, of these, about 60% use a pacifier/dummy. Research shows that the pacifier/dummy habit rests longer than previously, and the pacifier/dummies are used more intensely than before.

A serious effect of dummy use associated with well known and conventional pacifiers of the dummy type is socalled posterior crossbites with a forced bite. This is due to the fact that the dummy's teat-like bubble body presses the tongue down in the floor of the oral cavity. Thus, the tooth bow of the upper jaw looses support and is pressed inwardly of the cheek pressure. Simultaneously, the tongue presses the tooth bow of the lower jaw outwards. Recent studies show that 26% of Swedish girls using pacifiers had developed posterior crossbites with a forced bite (Confer øgaard B, Larsson E, Lindsten R. "The effect of sucking habits, cohort, sex, intercanine arch widths and breast and bottle feeding on posterior crossbite in 3-year-olds in Norway and Sweden. Am J Orthod Dentofac Orthoped 1994; 106: 161–6).

Crossbite having force-guidance is a serious bite error which may result in large deviations in the growth and development of the jaws. Therefore, National Health offers maximum repayment for the treatment, but tooth adjustment for small children is often complex and subjects the child to an unnecessary strain.

Another serious result of the use of pacifiers is the socalled "open bite" which is a consequence of the thick and straight passage required by known pacifiers between the teeth.

In a pacifier of the dummy type, the teat-like bubble body's free bubble on which the child sucks, assigned a disc-like stop body forming an outer counter member adapted to rest against the lips of the child, preventing the entire pacifier from landing within the mouth from where the child may try to swallow it. The outer stop disc usually carries a handle or the like.

DE 38 40 178 and U.S. Pat. No. 5,133,740 disclose pacifiers of the dummy type exhibiting common features and modes of operation. The pacifier means proper—the teat-imitating bubble body—is, in connection with each of these pacifiers, designed and shaped as two partially coalesced bubbles which, in the non-coalesced area, exhibit a U-/V-shaped cavity tapering from two freely projecting bubble portions in a direction towards the stop disc. The tongue tip will seek into said cavity. The double-arched bubble body passes into a rectilinear pipe portion or massive portion extending right-angled to the outer stop disc.

The design and shape of these known pacifiers will force the naturally curved tongue away from its natural motion paths/areas. Both these known solutions require large space within the oral cavity where the tongue ideally should be capable of staying in the upper part along the entire tooth bow. Both these known pacifiers involve a thick and straight passage between the teeth, and this is also unfortunate, as one rather should aim at achieving a broad, thin and slopingly extending passage between the teeth. Also, both these pacifiers will result in that the tongue is pressed down towards the lower jaw tooth bow, and "open bite" can develop therefrom.

The pacifiers according to DE 38 40 178 distinguishes itself specifically in that the bubble body of the pacifier will force the tongue down and away from the natural position at the inside of the upper jaw tooth bow. This may result in the development of crossbite force-guiding the lower jaw as described introductorily.

U.S. Pat. No. 5,133,740 discloses a dummy having many features common with conventional dummies. If the tongue becomes situated within said cavity, it will get an unnatural shape and can not maintain its place in the roof of the mouth. After a long time, this may result in an unfortunate bite development.

SUMMARY OF THE INVENTION

It has been a main object of the present invention to provide a pacifier allowing and favouring a correct positioning of the tongue during sucking. Thus, the tongue shall lie along the upper jaw tooth bow, maintaining its support from the side of the roof of the mouth in order to balance the cheek pressure. During the child's sucking on the bubble body of the pacifier, the tongue should get the opportunity of reaching as far as possible forth in the mouth.

According to the invention, the object is realized by means of a pacifier the characteristic features of which appear from the following description of a pacifier of the dummy type. The pacifier has at one outer end a bubble body for the child to suck on. A counter means, for example, in the form of a stop disc, forms an impact face against the child's lips. There may possibly be a handle ring, preferably connected by means of a suspension piece and an attachment portion. The pacifier also has an intermediate transition and connecting portion which, at one axial end, is connected to the bubble body and, at the other axial end, is connected to the stop disc or to the handle ring. The pacifier includes a bubble body asymmetrically shaped in relation to its connection point at an adjacent end portion of the transition and connecting portion. The transition and connecting portion comprises a concave, angled, and preferably rounded outer face. The outer face faces inwardly in the oral cavity in the position of use and forms a land area for the opposing portion of a tongue. The bubble body may be substantially constituted by a possibly double-curved, plate-like body. In side elevational view the body comprises a relatively long body that, in the portion of use, is a slopingly downwardly directed leg. Preferably, in relation thereto is angled a relatively short leg, with the stop disc having two longitudinal portions extending in the continuation of each other, one of which is intended to rest against the child's upper lip/upper lip area and the other being intended to rest against the child's lower lip/lower lip area. The two longitudinal portions are displaced in relation to each other. The outer face (the surface facing the bubble body of the longitudinal stop disc portion, is the lowermost in the position of use, and is situated somewhat closer to the bubble body than the corresponding outer face of the upper longitudinal stop disc portion.

Subordinate, advantageous features of the invention according to summarized in the above paragraph are defined in the following dependent sub claims. Thus, a subordinate, but important object is to secure that the pacifier gets into a correct position within the mouth; principally due to the asymmetrical shape of the bubble body.

Thus, the bubble body of the pacifier which is carried by an intermediate transition and connecting portion, is asymmetrical in side elevation view (position of use) and shaped as a curved, possible double-curved, plate-like member comprising two bubble portions of different lengths, one relatively long, lower bubble part passing relatively smooth into a substantially shorter, upper bubble part forming an angle with the longer bubble part, as seen in side elevational view.

This design and shape, especially in combination with new features of particularly the outer stop disc, prevent the tongue from being pressed down and forwardly against the lower jaw.

The outer end tip of the long, in correct position of use lowermost bubble part of the bubble body is, preferably, situated at a larger distance from the centre of the transition and connecting portion of the bubble body at the connecting piece than the outer tip end of the short bubble part.

The stop disc is formed with two substantially laterally displaced halves, more specifically: In a central, longitudinal section of the stop disc, the two longitudinal parts/halves are asymmetrical in relation to said centre, where the surface of the upper stop disc part facing the bubble body extends mainly concavely, at least across a part of the length thereof, the corresponding surface of the lower stop disc extending mainly convexely, at least across a part of the length thereof. The purpose of such a design and shape has i.a. been to keep the jaws in upper and lower position in relation to each other. The lower front teeth will be resting against the inner side of the upper front teeth. Moreover, the position is favourable for optimal positioning of the tongue and the resting position of the same. An intentional, inclined passage of the pacifier between the teeth is achieved, contributing to prevent erroneous positions of the front teeth. This shape of the stop disc which, wholly or across most of its length (height) may exhibit a concave lateral curvature, referred to position of use, facing the outer mouth portion of the child, likewise contributes to the correct orientation of the pacifier in the mouth. If the bubble body of the pacifier lands in an erroneous, 180° turned upside-down-position, the lowermost outer plate part in this erroneous position of use which corresponds to upper outer plate part in the structure proper, will hit the nose, while the uppermost part of the stop disc which is the lower part of the stucture proper, will hit the chin in an unpleasant manner. The child will immediately feel distaste and give his/her expression thereof, e.g. by spitting the pacifier out or by turning it into the correct position while still in the mouth.

In the position of use, the short bubble part, which may constitute a short continuation of the suction portion of the bubble body, will rest against the front part of the palate, behind the front teeth and, in combination with the specially shaped remaining part of the bubble, enables that the tongue is not forced away from the upper part of the oral cavity.

The free end of the long bubble part may be relatively pointed in order to prevent reliably that the tongue comes beneath the bubble. The short bubble part is defined by relatively plane faces.

The intermediate transition and connection portion should, particularly at an approximately central portion, be formed with a relatively small thickness combined with a relatively large width, in order to compensate strength-wise for said relatively small thickness. In this thin, broad portion approximately centrally of the length of the transition and connection portion (about in the middle between the bubble body and the stop disc) it is very advantageous to form oppositely facing grooves having notch-like cross-sectional shapes, displaced in the longitudinal direction of the transition portion. The downwardly facing groove constituting the upper groove in the position of use, accommodates the front teeth in the upper part of the mouth, while the lower, upwardly facing groove accommodates the front teeth in the lower part of the mouth.

Such a design of said intermediate transition portion, and especially the insignificant thickness, will contribute positively to allow the tongue to reach furthest forth in the mouth during sucking.

The stop disc may, particularly outside the restricting walls, advantageously be formed with bead-like circumferential edges causing the child's distaste if the stop disc or parts thereof should reach within the lips.

The stop disc or portions of the same may be formed with a number of lateral venting holes extending through the stop disc wall.

BRIEF DESCRIPTION OF THE DRAWINGS

Further advantages and features of a pacifier shaped and designed in accordance with the present invention are further explained in the following in connection with a non-limiting example of a possible embodiment which is diagrammatically illustrated on the attached drawings, wherein.

DETAILED DESCRIPTION OF THE INVENTION

Figure 2:
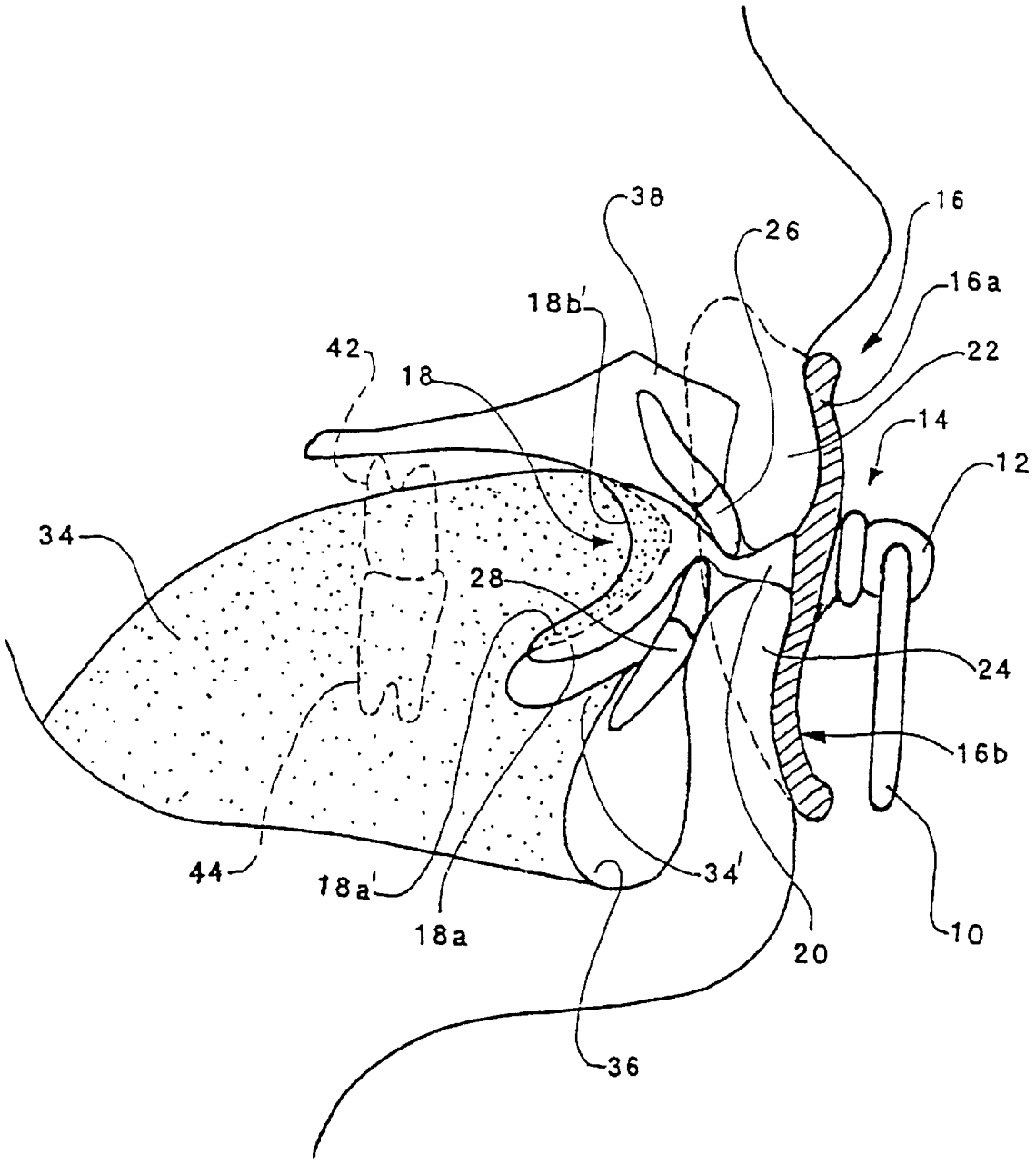
FIG. 2 shows the same pacifier in the same side elevational view in the position of use thereof, where upper and lower lip, upper and lower jaw with some teeth as well as the tongue have been illustrated.

In the examplary embodiment, the pacifier according to the invention is illustrated in the shape of a dummy generally comprising the following parts/portions: a non-compulsory handle ring 10 suspended for free rotation in a bearing piece 12 which is firmly connected to or formed integrally with, respectively, an attachment portion 14 firmly connected to a stop disc 16 incorporating two asymmetrical parts 16*a* and 16*b* extending in the continuation of each other, the longitudinal (vertical) central portion thereof extending irregularly, non-linearly between upper and lower end, referred to position of use, FIG. 2. Between the stop disc 16 and the bubble body 18, a transition and connection portion 20 is mounted, carrying the bubble body 18 at the free end thereof.

In said longitudinal central plane (hatched in FIG. 2), the two longitudinal parts 16*a* and 16*b* constituting extensions of each other, are approximately staggered in relation to each other. In the position of use, the lower stop disc part 16*b* will, with the arched surface facing towards the bubble body 18, apart from in the central portion at the transition and connection portion's 20 connection place on the stop disc 16, be spaced at a somewhat larger distance from an imaginary plane through the handle ring 10 suspended vertically from the piece. These mutually displaced stop disc parts 16*a* and 16*b* form suitable stop surfaces for the lips of the child, upper lip 22, FIG. 2, becoming resting supportingly against the stop disc part 16*a*, while lower lip 24 becomes resting supportingly against the stop disc part 16*b*.

Figure 3:
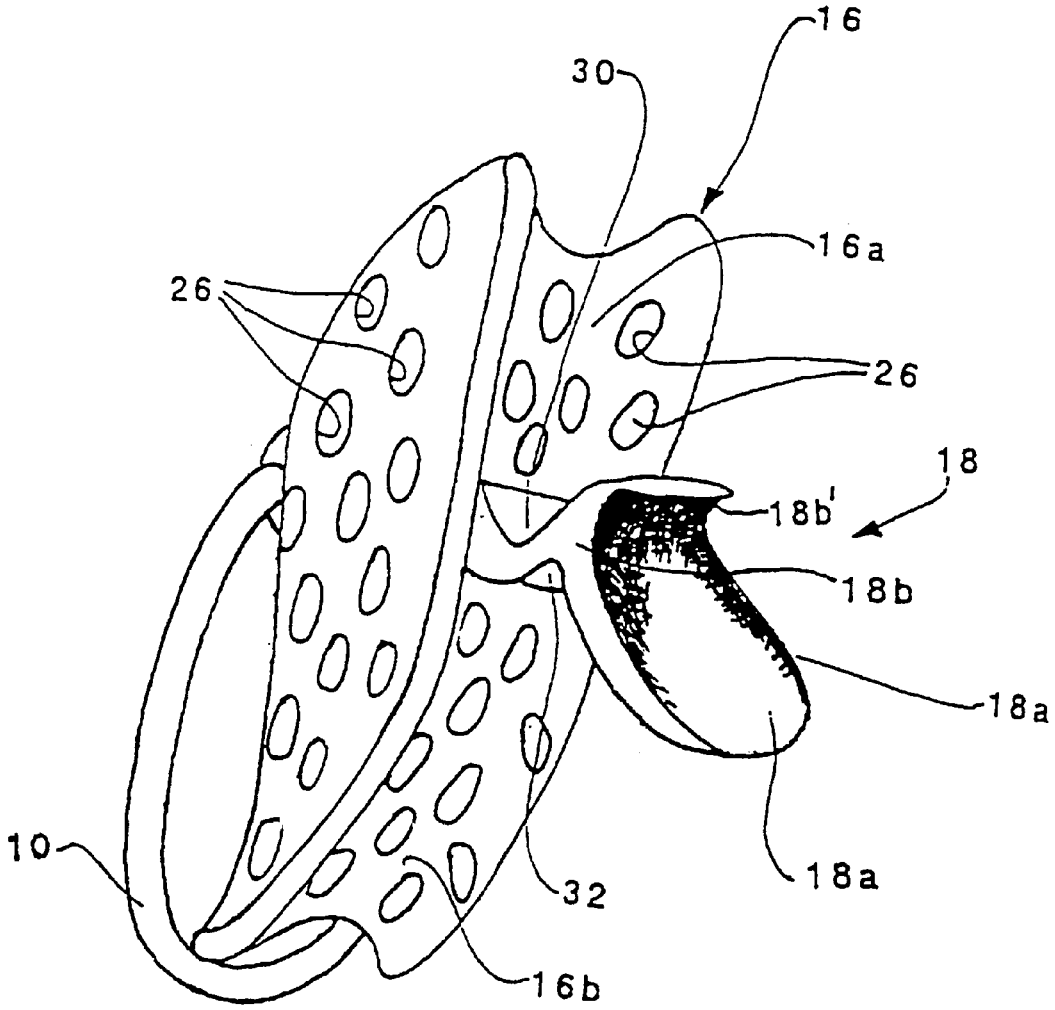
FIG. 3 shows a perspective view of the pacifier as seen obliquely from below.

It appears from FIG. 3 that the stop disc 16 has lateral, through-going vent holes 26. Thus, in case the child should get the stop disc 16 into its mouth, the child will still be able to breath.

Figure 1:
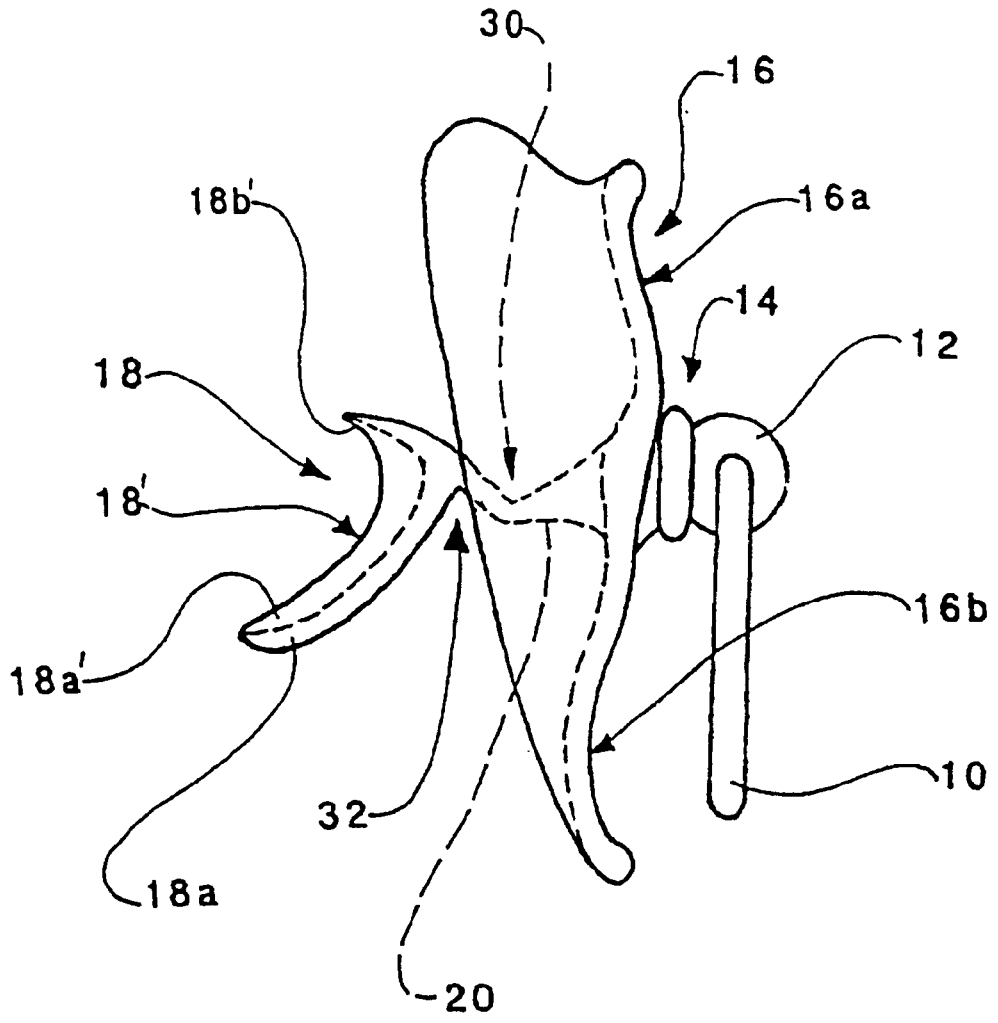
FIG. 1 shows a side elevational view of a pacifier formed in accordance with the present invention.

From FIGS. 1–3 it appears that the stop disc 16 has a concave curvature laterally.

The intermediate transition and connection portion 20 is formed and dimensioned such that it exhibits a small thickness and a relatively large width, especially in the area within which the portion 20 will be situated in the mouth, between the front teeth 26 of the upper part of the mouth and the front teeth 28 in the lower part of the mouth, FIG. 2.

In the last-mentioned area, the transition and connection portion 20 exhibits two oppositely directed, in longitudinal cross-sections notch-like grooves 30 and 32, respectively, see particularly FIG. 3.

From FIG. 2 appears how the upper front teeth 26 engage guidingly down into the portion's 20 upper, upwardly open, downwardly directed groove 30, while the lower front teeth 28 engage guidingly up into the portion's 20 lower, downwardly open groove 32. The lower groove 32 is situated closer to the bubble body 18 than the upper groove 30 of the transition and connection portion 20.

The bubble body 18 carried at the free end of the transition and connecting portion 20 has an outer face 18' facing away from the transition and connecting portion 20 as well as a concave angulation at the connecting place of the bubble body 18 at the free end of the portion 20, so that said outer face 18' which, possibly, has a lateral concave curvature, in respect of said connecting place, comprises a large, lower outer face portion 18*a*' passing into a far smaller, upper outer face portion 18*b*', the outer edge of the whole outer face 18' in side elevational view, FIGS. 1 and 2, extending along an irregular curve.

The lower part 18*a* of the bubble body 18 has an approximately even thickness from its outer, free end to the bubble body's 18 connecting place at the transition and connecting portion 20. Thus, the lower part 18*a* has approximately parallel faces. It has been found that such parallel faces are specially favourable for the positioning of the tongue within the mouth during sucking.

The transition and connecting portion's 20 outer portion close to the connecting place of the bubble body 18, i.e. in the area of said passage for the portion 20 between the teeth, may advantageously slope, preferably obliquely upwardly in the position of use, contributing to letting the tongue take a natural and convenient position in the mouth during sucking. The design and shape are especially advantageous with a view of avoiding crossbite.

Conventional pacifiers of the dummy type often cause bite errors such as open bite and crossbite in the side segments. Open bite represents an aesthetical and functional problem for the little child, but is often self-correcting after the child has terminated the pacifier use. On the other hand, the crossbite is most often transferred to the permanent set of teeth. As explained previously, crossbite is formed in that known pacifiers force the tongue down in the floor of the cavity of the mouth. Thus, the tongue 34 presses the lower jaw tooth bow 36 outwardly. Simultaneously, the upper jaw tooth bow 38 looses the support from the tongue 34, and the cheek pressure presses the upper jaw tooth bow 38 inwardly. A disproportion arises between the tooth bow widths in the upper and lower jaw, often resulting in a crossbite. Crossbite resulting from the use of conventional pacifiers is often combined with a force-guidance of the lower jaw. This is a serious functional bite error requiring that a jaw orthopedical treatment is started at an early stage, in order to avoid a negative influence on the growth and development of the jaws.

According to the present invention, the general design and shape of the pacifier have been carried out with a view of avoiding the development of crossbite with a force-guidance of the lower jaw of children and, thus, primarily preventing that the pacifier presses the tongue down in the floor of the oral cavity, which i.a. may result in that the upper jaw's tooth bow becomes too narrow and the lower jaw's tooth bow too broad. Upon clenching the teeth, the lower jaw is pressed out to one side. The pacifier according to the invention, on the contrary, is designed and shaped such that crossbite with forced guiding of the lower jaw is prevented; this is achieved through the special shape, positioning and orientation of the bubble body within the mouth in relation to the tongue 34, FIG. 2, confer the unrestrained, natural position and condition of the tongue. Beneath the tongue, underlying salivary glands, frenum, etc., 34' are taking positions without restraint, substantially unaffected by the bubble body 18 of the pacifier. Primarily the pacifier prevents the tongue 34,34' from being pressed down in the floor of the oral cavity.

The slopingly upwardly directed passage course between the front teeth 26, 28 as well as the special design of the stop disc 16 will, when the pacifier accordning to the invention is used over a long period of time, results in correct positions of the teeth, where the free outer end portion of the lower front tooth/teeth 28 will land on the inner side of the upper front tooth/teeth 26. Moreover, possibly opposing grinders 42,44 get a correct mutually positioning and orientation in relation to each other.

The face 18*a*',18*b*' of the bubble body 18 which primarily comes into contact with the upper side of the tongue 34, FIG. 2, may according to FIG. 3 exhibit an approximately oval circumferential shape, possibly with a weak curvature laterally, at least across a longitudinal portion thereof. The bubble body 18, particularly the detailed design and shape of its outer face 18*a*',18*b*' will continuously be the subject matter of modifications and adaptations based on experiments and experiences. However, the bubble body 18 will have an asymmetrical plate-like shape in relation to its connection point in relation to the transition and connecting portion 20 at the adjacent axial end thereof. As mentioned, such an angled plate piece may have a weak concave curvature in at least one direction, possibly exhibiting a double curvature, i.e. a combined, weak concave curvature in both the longitudinal and lateral direction, at least across a certain longitudinal extent of the bubble body 18, as referred to an elongate (oval) bubble body 18. However, nothing should prevent the use of a resting surface 18*a*',18*b*' on the bubble body 18 for the tongue 34, exhibiting substantially a square/circular circumferential shape.

The outer face 18*b*' of the bubble body 18 may, possibly, be omitted.

We claim:

1. A pacifier for a child, comprising:

a stop disc forming a contact surface against the child's lips, comprising:

an upper longitudinal portion configured to rest against the child's upper lip area, and a lower longitudinal portion configured to rest against the child's lower lip area, wherein the upper and lower longitudinal portions extend in continuation of each other and wherein the lower longitudinal portion is displaced with respect to the upper longitudinal portion;

an intermediate transition and connecting portion having a first axial end connected to the stop disc;

a bubble body connected to a second axial end of the transition and connecting portion for a child to suck on, the bubble body being asymmetrically shaped with respect to an axis extending through a connection point at the second axial end of the transition and connecting portion, and comprising a plate-like body having a first part extending downwardly and a second part extending upwardly, the first part being longer than the second part, wherein the plate-like body has a concave outer surface which faces inwardly into the child's oral cavity and forms a land area for a portion of the child's tongue.

2. The pacifier of claim 1, wherein the first part has a first end and the second part has a second end, and wherein the first end is positioned at a larger axial distance from the second axial end of the transition and connection portion than the second end of the second part.

3. The pacifier of claim 1, wherein the lower longitudinal portion has, along a section of its longitudinal extent, a convex curvature, and wherein the upper longitudinal portion has, along a section of its longitudinal extent, a concave curvature.

4. The pacifier of claim 3, wherein the convex curvature of the lower longitudinal portion of the stop disc is most pronounced at a distance from the connection point, and wherein the concave curvature of the upper longitudinal portion of the stop disc is most pronounced in proximity of the connection point.

5. The pacifier of claim 1, wherein the contact surface of the stop disc has a concave lateral curvature.

6. The pacifier of claim 1, wherein the transition and connection portion between the bubble body and the stop disc is formed and dimensioned to have a small thickness when viewed from a side, and to have a large width at right angles to the side view.

7. The pacifier of claim 6, wherein the transition and connecting portion comprises a transversely extending upper groove having a notch-like cross-sectional shape and configured to accommodate upper front teeth, and a transversely extending lower groove having a notch-like cross-sectional shape configured to accommodate lower front teeth, and wherein the lower groove is located further from the connection point than the upper groove.

8. The pacifier of claim 7, wherein the lower groove is located by the connection point of the bubble body.

9. The pacifier of claim 6, wherein the transition and connecting portion has in proximity of the first axial end an inclined section which follows an upwardly sloping course.

10. The pacifier of claim 1, wherein the bubble body and the transition and connecting portion are constituted by one unit of the same material.

11. The pacifier of claim 1, further comprising a handle ring, a suspension piece and an attachment portion which are connected to the stop disc.

* * * * *